US011676755B2

(12) United States Patent
Tonogai et al.

(10) Patent No.: US 11,676,755 B2
(45) Date of Patent: Jun. 13, 2023

(54) COIL COMPONENT AND ITS MANUFACTURING METHOD

(71) Applicant: TDK CORPORATION, Tokyo (JP)

(72) Inventors: Toru Tonogai, Tokyo (JP); Yuichi Oyanagi, Tokyo (JP); Kyosuke Inui, Tokyo (JP); Maki Mannen, Tokyo (JP)

(73) Assignee: TDK CORPORATION, Tokyo (JP)

( * ) Notice: Subject to any disclaimer, the term of this patent is extended or adjusted under 35 U.S.C. 154(b) by 458 days.

(21) Appl. No.: 16/841,225

(22) Filed: Apr. 6, 2020

(65) Prior Publication Data

US 2020/0335264 A1 Oct. 22, 2020

(30) Foreign Application Priority Data

Apr. 22, 2019 (JP) ..... JP2019-080783

(51) Int. Cl.
*H01F 27/29* (2006.01)
*H01F 27/32* (2006.01)
*H01F 27/255* (2006.01)

(52) U.S. Cl.
CPC ..... *H01F 27/29* (2013.01); *H01F 27/255* (2013.01); *H01F 27/32* (2013.01)

(58) Field of Classification Search
CPC ..... H01F 27/29; H01F 27/255; H01F 27/32; H01F 41/04; H01F 2017/048; H01F 17/045; H01F 27/2828; H01F 27/292; H01F 41/0246; H01F 41/127; H01F 41/10; H01F 27/306; H01F 41/076; H01F 41/098
See application file for complete search history.

(56) References Cited

U.S. PATENT DOCUMENTS 5,912,609 A * 6/1999 Usui ..... H01F 17/043 336/83
8,723,629 B1 * 5/2014 Liu ..... H01F 1/14791 336/212
11,335,496 B2 * 5/2022 Kang ..... H01F 27/29
2003/0206089 A1 * 11/2003 Shikama ..... H01F 27/255 336/221
2010/0237973 A1 * 9/2010 Cheng ..... H01F 27/292 336/83
2013/0255071 A1 * 10/2013 Muneuchi ..... H01F 27/292 29/605

(Continued)

FOREIGN PATENT DOCUMENTS

JP 2013149814 A 8/2013
JP 2014175437 A 9/2014
TW 201916066 A 4/2019

*Primary Examiner* — Mang Tin Bik Lian
(74) *Attorney, Agent, or Firm* — Young Law Firm, P.C.

(57) ABSTRACT

Disclosed herein is a coil component that includes a magnetic element body, a coil conductor embedded in the magnetic element body and having an end portion exposed from the magnetic element body, and a terminal electrode connected to the end portion of the coil conductor. The terminal electrode includes a conductive resin contacting the end portion of the coil conductor and containing conductive particles and a resin material, and a metal film covering the conductive resin. The end portion of the coil conductor has an exposed surface exposed from the magnetic element body and contacting the conductive resin and a non-exposed surface covered with the magnetic element body. The exposed surface is larger in surface roughness than the non-exposed surface.

9 Claims, 6 Drawing Sheets

(56) References Cited

U.S. PATENT DOCUMENTS

| | | | | |
|---|---|---|---|---|
| 2016/0268038 | A1* | 9/2016 | Choi | H01F 27/255 |
| 2017/0271081 | A1 | 9/2017 | Maki et al. | |
| 2018/0130600 | A1* | 5/2018 | Xia | C03C 14/008 |
| 2018/0137965 | A1* | 5/2018 | Lee | H01F 17/0033 |
| 2018/0308620 | A1* | 10/2018 | Shinohara | H01F 17/045 |
| 2018/0337001 | A1* | 11/2018 | Tozawa | H01F 17/0013 |
| 2019/0304672 | A1* | 10/2019 | Kang | H01F 27/292 |

* cited by examiner

COIL COMPONENT AND ITS MANUFACTURING METHOD

BACKGROUND OF THE INVENTION

Field of the Invention

The present invention relates to a coil component and its manufacturing method and, more particularly, to a coil component having a structure in which a wire-shaped coil conductor is embedded in a magnetic element body and its manufacturing method.

Description of Related Art

As a coil component having the structure in which a wire-shaped coil conductor is embedded in a magnetic element body, coil components described in JP 2014-175437A and JP 2013-149814A are known. In the coil components described in JP 2014-175437A and JP 2013-149814A, an end portion of the coil conductor embedded in the magnetic element body is exposed from the magnetic element body, and the surface of the exposed end portion is plated, to thereby form a terminal electrode.

However, in the coil component described in JP 2014-175437A, the terminal electrode is directly formed by plating on the end portion of the coil conductor, so that it is difficult to form the terminal electrode on the surface of the magnetic element body from which the coil conductor is not exposed. On the other hand, in the coil component described in JP 2013-149814A, a pasty conductive resin is applied on the surface of the magnetic element body so as to contact the end portion of the coil conductor, followed by curing and then formation of a plating film on the surface of the conductive resin, so that it is possible to easily form the terminal electrode on the surface of the magnetic element body from which the coil conductor is not exposed.

As described above, electrical conduction between the conductive resin and the plating film is ensured by metal bonding between the conductive particles contained in the conductive resin and the plating film, while electrical conduction between the conductive resin and the coil conductor is ensured by physical contact between the conductive particles contained in the conductive resin and the coil conductor. Therefore, high reliability is more difficult to ensure for the connection between the conductive resin and the coil conductor than for the connection between the conductive resin and the plating film.

SUMMARY

It is therefore an object of the present invention to provide a coil component having a structure in which a wire-shaped coil conductor is embedded in a magnetic element body, capable of improving the connection reliability between the coil conductor and the conductive resin. Another object of the present invention is to provide a manufacturing method for such a coil component.

A coil component according to the present invention includes a magnetic element body, a coil conductor embedded in the magnetic element body and having an end portion exposed from the magnetic element body, and a terminal electrode connected to the end portion of the coil conductor, wherein the terminal electrode includes a conductive resin contacting the end portion of the coil conductor and containing conductive particles and a resin material and a metal film covering the conductive resin, the end portion of the coil conductor has an exposed surface exposed from the magnetic element body and contacting the conductive resin and a non-exposed surface covered with the magnetic element body, and the exposed surface is larger in surface roughness than the non-exposed surface.

According to the present invention, the surface roughness of the exposed surface of the end portion of the coil conductor that contacts the conductive resin is large, so that it is possible to improve connection reliability between the end portion of the coil conductor and the conductive resin.

In the present invention, the exposed surface of the coil conductor may have an outer exposed surface positioned outside the magnetic element body and an inner exposed surface embedded in the magnetic element body without contacting the magnetic element body, and the conductive resin may contact both the outer and inner exposed surfaces. This can further improve connection reliability between the end portion of the coil conductor and the conductive resin.

In the present invention, the surface of the magnetic element body may be covered with a resin coating, and a part of the conductive resin may be formed on the resin coating. With this configuration, even when a conductive magnetic material is exposed to the surface of the magnetic element body, the conductive magnetic material exposed to the surface of the magnetic element body and the conductive resin are prevented from contacting each other.

In the present invention, the conductive particles contained in the conductive resin may be bonded together through sintered metal. This can further reduce a resistance value of the conductive resin.

In the present invention, the magnetic element body may include a lower magnetic element body positioned within the inner diameter region of the coil conductor and an upper magnetic element body positioned outside the coil conductor, and the lower magnetic element body may be higher in density than the upper magnetic element body. Such a configuration can be obtained when a pressure for pressing the upper magnetic element body in a state where the coil conductor is mounted on the lower magnetic element body is set lower than a pressure for singly pressing the lower magnetic element body so as to prevent deformation or disconnection of the coil conductor.

A coil conductor manufacturing method according to the present invention includes: a first step of embedding a coil conductor in a magnetic element body such that an end portion of the coil conductor is exposed from the magnetic element body; a second step of covering the surface of the magnetic element body with a resin coating; a third step of partially peeling the resin coating by laser beam irradiation until the end portion of the coil conductor gets exposed; a fourth step of forming a conductive resin on the surfaces of the magnetic element body and resin coating so as to contact the end portion of the coil conductor; and a fifth step of forming a metal film on the surface of the conductive resin, wherein in the third step, a laser beam is irradiated until the exposed surface of the end portion of the coil conductor gets rough.

According to the present invention, a laser beam is irradiated until the exposed surface of the end portion of the coil conductor gets rough, so that it is possible to improve connection reliability between the end portion of the coil conductor and the conductive resin.

As described above, according to the present invention, there can be provided a coil component having a structure in which a wire-shaped coil conductor is embedded in a magnetic element body, capable of improving the connection reliability between the coil conductor and the conductive resin.

DETAILED DESCRIPTION OF THE EMBODIMENTS

Hereinafter, a preferred embodiment of the present invention will be described in detail with reference to the accompanying drawings.

Figure 1:
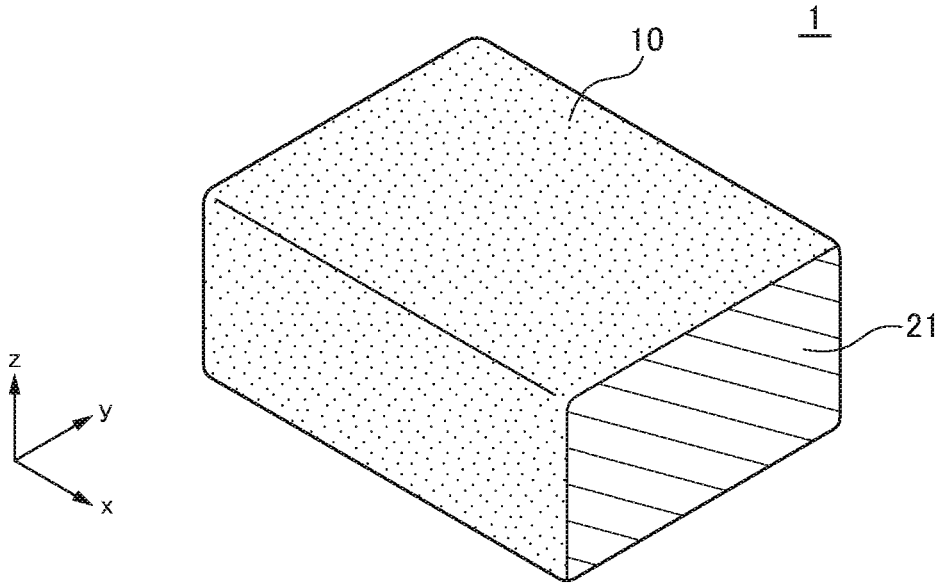
FIG. 1 is a schematic perspective view of a coil component according to a preferred embodiment of the present invention as viewed from the upper surface side.
Figure 2:
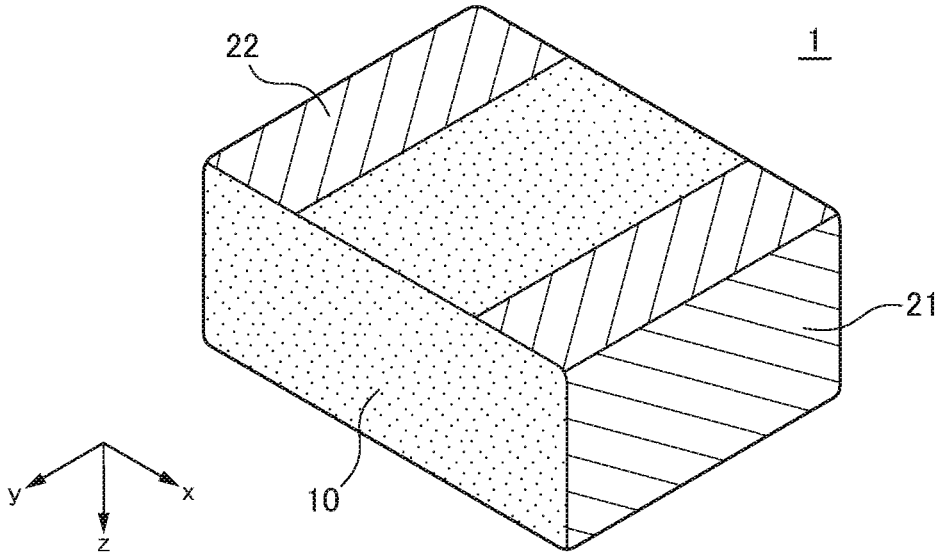
FIG. 2 is a schematic perspective view of the coil component shown in FIG. 1 as viewed from the mounting surface side.
Figure 3:
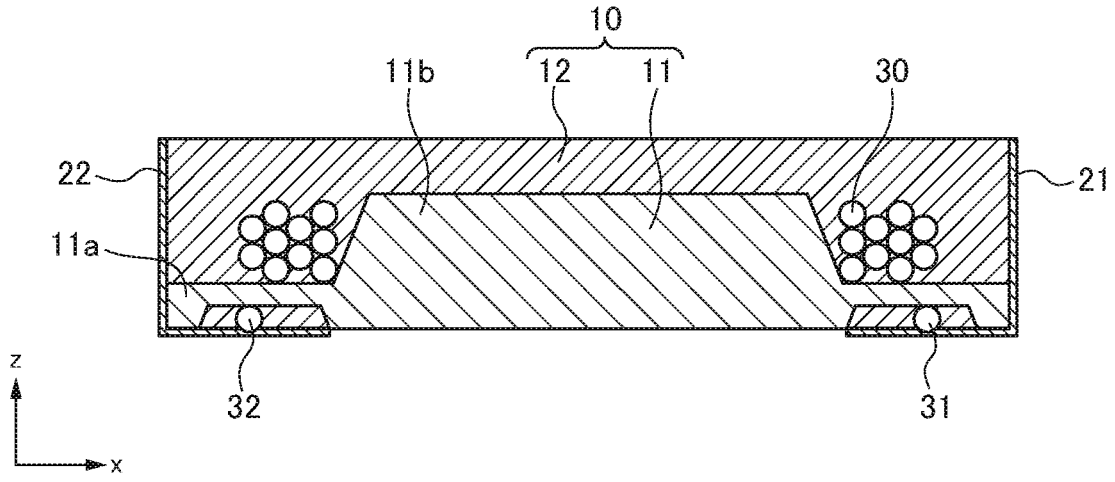
FIG. 3 is an xz cross-sectional view of the coil component shown in FIG. 1.

FIGS. 1 and 2 are schematic perspective views each illustrating the outer appearance of a coil component 1 according a preferred embodiment of the present invention. FIG. 1 is a perspective view as viewed from the upper surface side, and FIG. 2 is a perspective view as viewed from the mounting surface side. FIG. 3 is an xz cross-sectional view of the coil component 1, and FIG. 4 is a yz cross-sectional view of the coil component 1.

As illustrated in FIGS. 1 to 4, the coil component 1 according to the present embodiment includes a magnetic element body 10 having a substantially rectangular paralleled shape, a coil conductor 30 embedded in the magnetic element body 10, and two terminal electrodes 21 and 22 each provided so as to extend over a mounting surface and a side surface of the magnetic element body 10 and to be connected to the coil conductor 30.

The magnetic element body 10 is made of a composite magnetic material containing a magnetic material and a binder and includes a lower magnetic element body 11 and an upper magnetic element body 12. The magnetic material contained in the composite magnetic material is particularly preferably soft magnetic metal powder having high permeability, and examples thereof include: ferrites such as Ni—Zn, Mn—Zn, and Ni—Cu—Zn; permalloy (Fe—Ni alloy); super permalloy (Fe—Ni—Mo alloy); sendust (Fe—Si—Al alloy); Fe—Si alloy; Fe—Co alloy; Fe—Cr alloy; Fe—Cr—Si alloy; Fe; amorphous (Fe group based alloy); and nanocrysyal. The binder may be a thermosetting resin material such as epoxy resin, phenol resin, silicon resin, diallyl phthalate resin, polyimide resin, or urethane resin.

Figure 4:
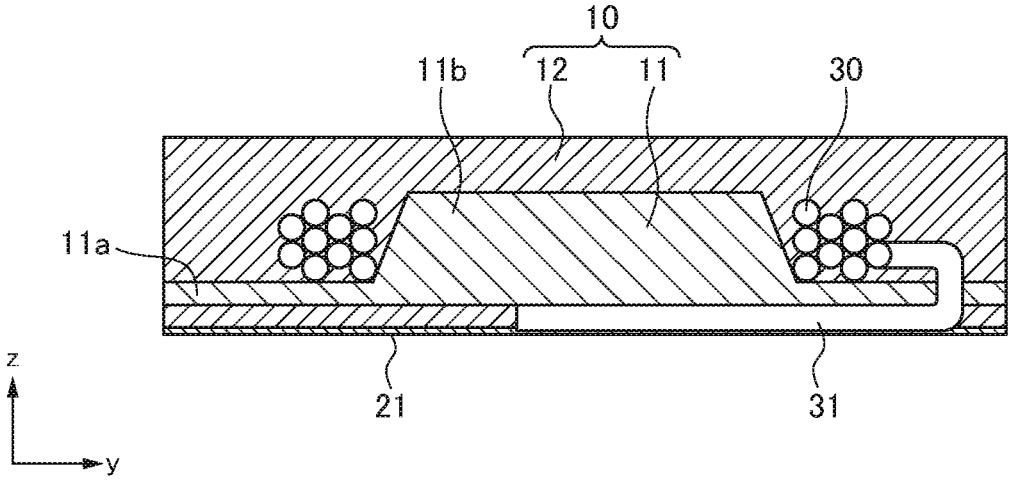
FIG. 4 is a yz cross-sectional view of the coil component shown in FIG. 1.

As illustrated in FIGS. 3 and 4, the lower magnetic element body 11 has a flat part 11*a* and a protruding part 11*b*, and the coil conductor 30 is placed on the flat part 11*a* such that the protruding part 11*b* is inserted into the inner diameter part of the coil conductor 30. Accordingly, the lower magnetic element body 11 is positioned in a region below the coil conductor 30 and within the inner diameter region thereof. The upper magnetic element body 12 is a portion where the coil conductor 30 placed on the lower magnetic element body 11 is embedded. Accordingly, the upper magnetic element body 12 is positioned above the coil conductor 30 and outside thereof. Although not particularly limited, in the present embodiment, the protruding part 11*b* has a tapered shape, so that when the lower magnetic element body 11 is molded using a die, the protruding part 11*b* is easily removed from the die.

The coil conductor 30 is a wire-shaped coated conducting wire obtained by applying insulating coating on a core material of copper (Cu) or the like. In the present embodiment, one coil conductor 30 is wound by a plurality of turns around the protruding part 11*b*. One end 31 and the other end 32 of the coil conductor 30 are exposed from the magnetic element body 10 to be connected respectively to the terminal electrodes 21 and 22. The coil conductor 30 may be a round wire having a circular cross section or a flat wire having a rectangular cross section.

Figure 5:
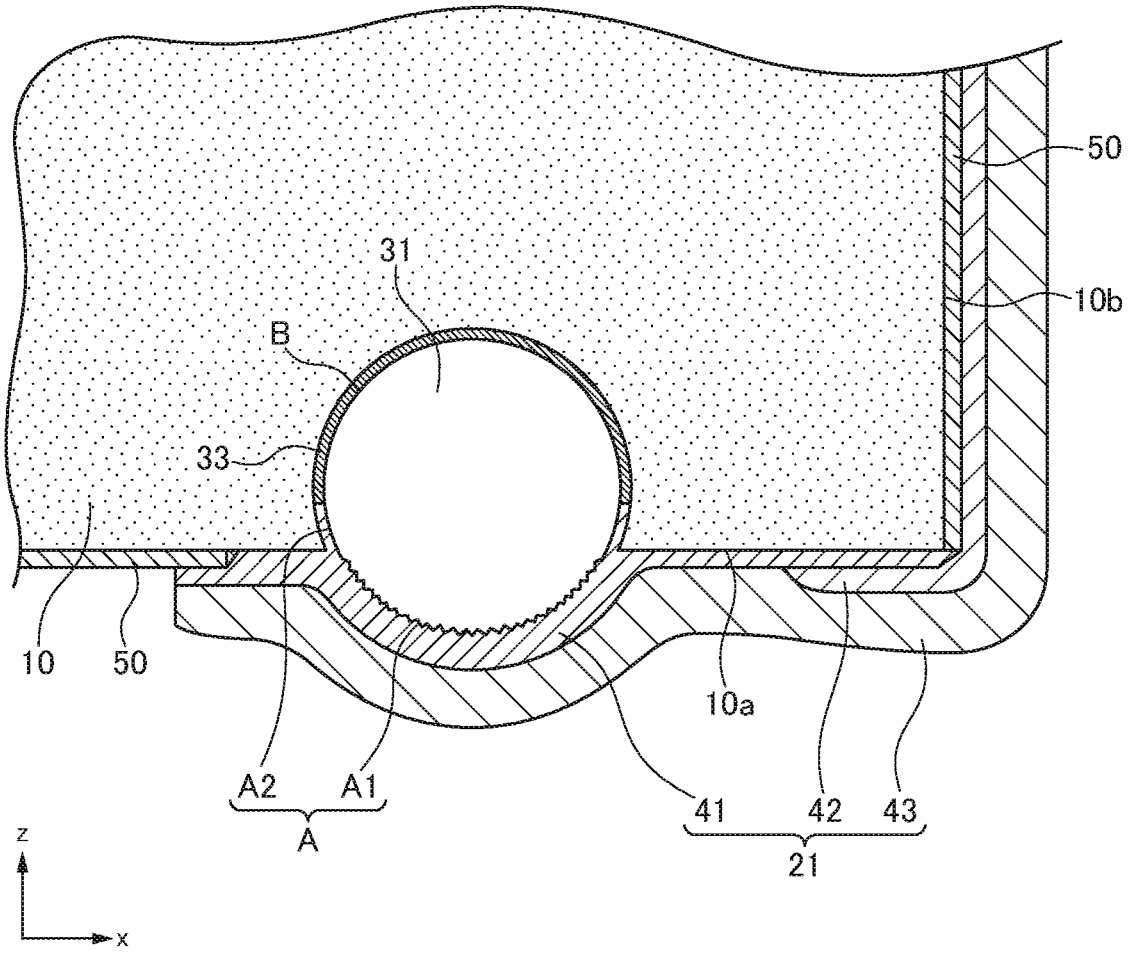
FIG. 5 is a schematic cross-sectional view illustrating, in an enlarged manner, a connection portion between one end of a coil conductor and a terminal electrode.

FIG. 5 is a schematic cross-sectional view illustrating, in an enlarged manner, a connection portion between the one end 31 of the coil conductor 30 and the terminal electrode 21. A connection portion between the other end 32 of the coil conductor 30 and the terminal electrode 22 has a structure similar to that of the forgoing connection portion of FIG. 5, so overlapping description will be omitted.

As illustrated in FIG. 5, the one end 31 of the coil conductor 30 is partially embedded in the magnetic element body 10 and partially exposed. More specifically, the one end 31 of the coil conductor 30 has an exposed surface A having an insulating coating 33 removed therefrom and exposed from the magnetic element body 10 and a non-exposed surface B covered with the magnetic element body 10 through the insulating coating 33. The exposed surface A has an outer exposed surface A1 positioned outside the magnetic element body 10 and an inner exposed surface A2 embedded in the magnetic element body 10 without contacting the magnetic element body 10. While the inner exposed surface A2 is embedded in the magnetic element body 10, the former is separated from the latter by the thickness of the insulating coating 33 due to the absence of the insulating coating 33. The exposed surface A is larger in surface roughness than the non-exposed surface B, whereby a contact area of the exposed surface A with the terminal electrode 21 is increased.

The surface of the magnetic element body 10 is covered with a resin coating 50 excluding an area thereof where the one and the other ends 31 and 32 of the coil conductor 30 are exposed. Although it is not essential to provide such a resin coating 50 in the present invention, the existence of the resin coating 50 allows application of coating even when a conductive magnetic material is exposed to the surface of the magnetic element body 10.

As illustrated in FIG. 5, the terminal electrode 21 includes a first conductive resin 41, a second conductive resin 42, and a metal film 43. The first and second conductive resins 41 and 42 both contain conductive particles and a resin material and function as conductive resin layers serving as underlying layers of the metal film 43. In the present embodiment, the specific surface area of the conductive particles contained in the first conductive resin 41 is larger than that of the conductive particles contained in the second conductive resin 42. In other words, the average particle volume of the conductive particles contained in the second conductive resin 42 is larger than that of the conductive particles contained in the first conductive resin 41.

The first conductive resin 41 is formed on the surface of the magnetic element body 10 so as to contact the exposed surface A of the magnetic element body 10. Accordingly, the first conductive resin 41 contacts both the exposed surface A of the coil conductor 30 and a mounting surface 10*a* of the magnetic element body 10. The first conductive resin 41 may be partially provided on the resin coating 50. The first conductive resin 41 contacts both the outer and inner exposed surfaces A1 and A2 of the exposed surface A of the coil conductor 30, whereby connection reliability is improved.

The second conductive resin 42 covers a side surface 10*b* of the magnetic element body 10 through the resin coating 50 and partially goes around to the mounting surface 10*a* side to contact the first conductive resin 41. The second conductive resin 42 does not directly contact the exposed surface A of the coil conductor 30 but is electrically connected to the coil conductor 30 through the first conductive resin 41. Although the second conductive resin 42 covers only a part of the first conductive resin 41 in the example of FIG. 5, it may cover the entire surface of the first conductive resin 41.

The metal film 43 is formed by plating on the surfaces of the first and second conductive resins 41 and 42. The metal film 43 may be a laminated film of nickel (Ni) and tin (Sn). Thus, the metal film 43 is not formed directly on the magnetic element body 10, but formed thereon through the first conductive resin 41 or second conductive resin 42.

As described above, the coil component 1 according to the present embodiment uses two kinds of conductive resins differing in the specific surface area of the conductive particles. The first conductive resin 41 contains the conductive particles with a large specific surface area (a small particle volume), so that it is possible to ensure a sufficient contact area between the exposed surface A of the coil conductor 30 and the conductive particles. Further, by increasing the content ratio of the magnetic material, adhesion with respect to the exposed surface A of the coil conductor 30 and the surface of the magnetic element body 10 is improved. On the other hand, the second conductive resin 42 contains the conductive particles with a small specific surface area (a large particle volume), so that bonding strength between the conductive particles and the metal film 43 formed by plating is enhanced.

The following describes a manufacturing method for the coil component 1 according to the present embodiment.

Figure 6:
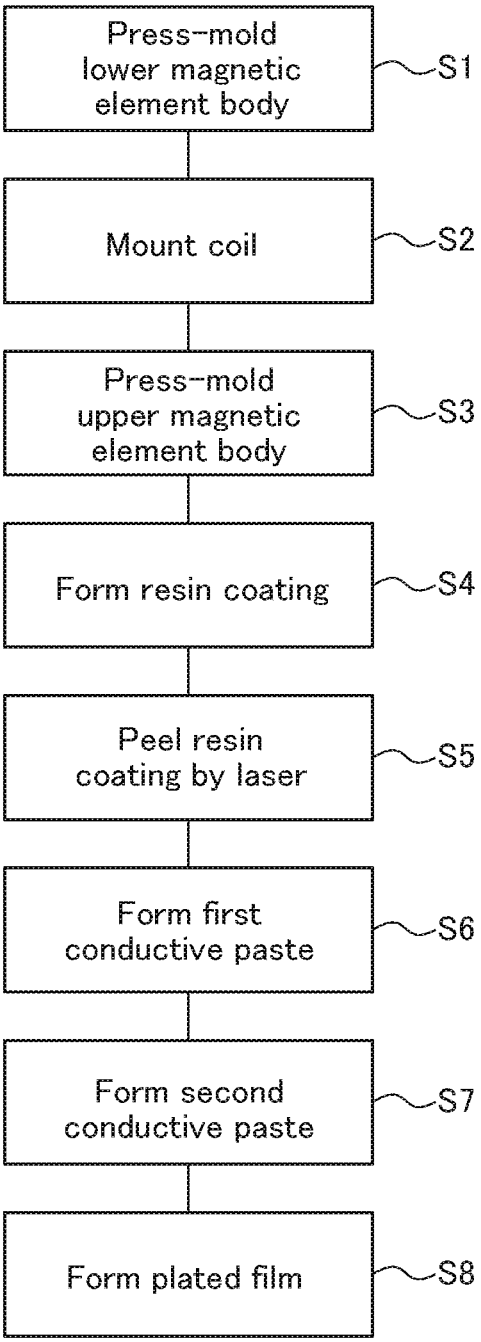
FIG. 6 is a flowchart for explaining manufacturing processes of the coil component shown in FIG. 1.

FIG. 6 is a flowchart for explaining manufacturing processes of the coil component 1 according to the present embodiment.

Figure 7:
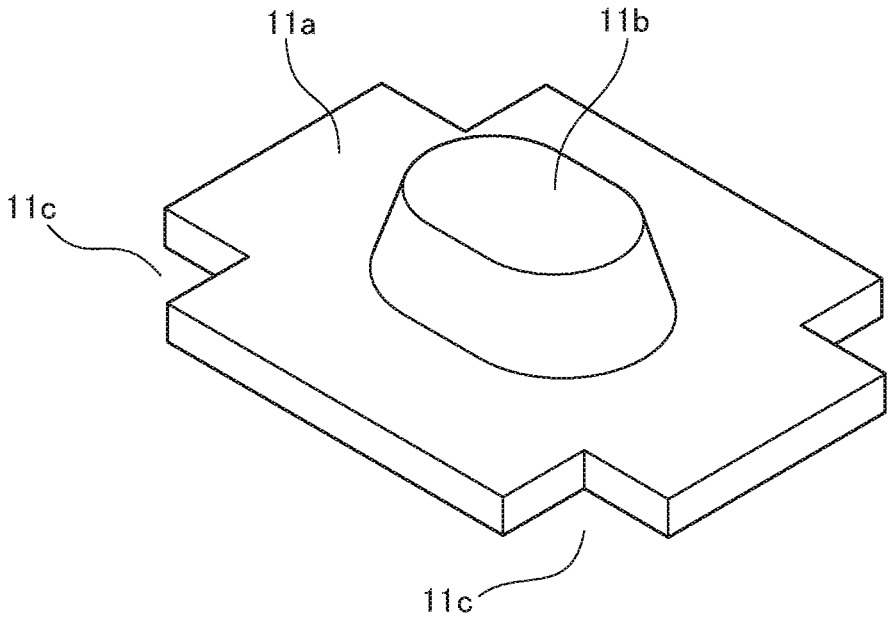
FIG. 7 is a schematic perspective view illustrating the shape of a press-molded lower magnetic element body.

First, a first composite magnetic material containing a magnetic material and a binder is prepared and subjected to pressing to thereby mold the lower magnetic element body 11 (step S1). The form of the first composite magnetic material is not particularly limited and may be powdery, liquid, or pasty. The molded lower magnetic element body 11 is shaped as illustrated in FIG. 7 and has the flat part 11*a* and the protruding part lib. The flat part 11*a* has openings 11*c*. Although the lower magnetic element body 11 illustrated in FIG. 7 corresponds to a single coil component 1, simultaneous molding of a large number of the lower magnetic element bodies 11 arranged in an array allows a plurality of the coil components 1 to be obtained.

Figure 8:
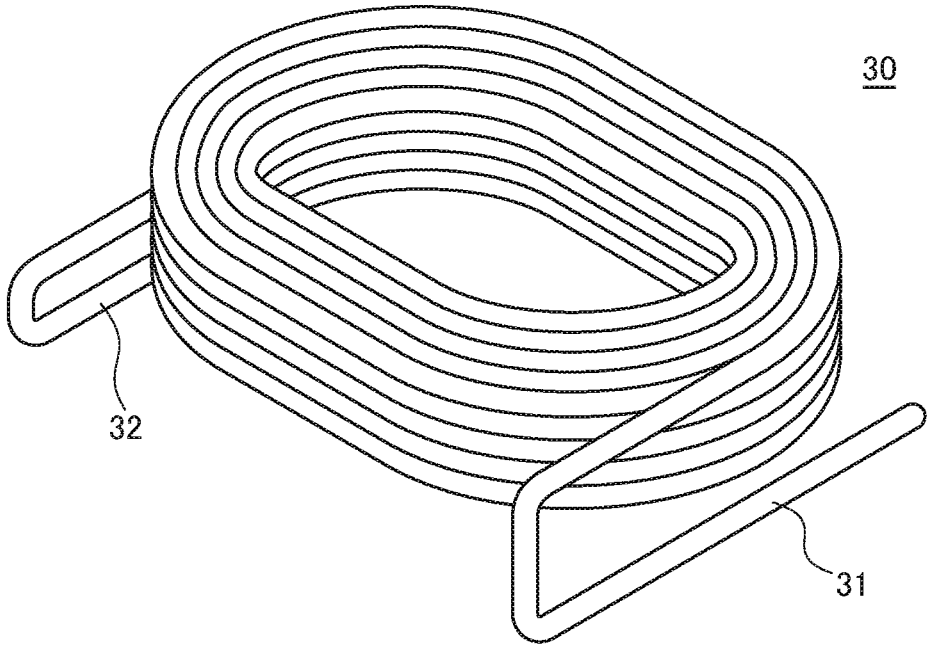
FIG. 8 is a schematic perspective view illustrating the shape of the coil conductor.

Then, the coil conductor 30 in an air-core shape wound as illustrated in FIG. 8 is prepared and is mounted on the lower magnetic element body 11 such that the protruding part 11*b* is inserted into the inner diameter region of the coil conductor 30 (step S2). At this time, the mounting is made such that the one and the other ends 31 and 32 of the coil conductor 30 are positioned on the back surface side of the lower magnetic element body 11 through the openings 11*c*.

Then, a second composite magnetic material containing a magnetic material and a binder is prepared and subjected to pressing together with the lower magnetic element body 11 on which the coil conductor 30 is mounted to thereby mold the upper magnetic element body 12 (step S3). The form of the second composite magnetic material is not particularly limited and may be powdery, liquid, or pasty. Further, the composition of the second composite magnetic material may be the same as or different from that of the first composite magnetic material. As a result, the coil conductor 30 is embedded in the magnetic element body 10 constituted of the lower and upper magnetic element bodies 11 and 12, and the one and the other ends 31 and 32 of the coil conductor 30 are exposed from the magnetic element body 10.

A pressure for press-molding the upper magnetic element body 12 may be lower than that for press-molding the lower magnetic element body 11. This is because that the coil conductor 30 does not exist in the stage of press-molding the lower magnetic element body 11, so that pressing can be carried out at a high pressure, while the upper magnetic element body 12 is press-molded together with the coil conductor 30, so that when the pressing is carried out at an excessively high pressure, deformation or disconnection of the coil conductor 30 may occur. Particularly, when a powdery material is used as the composite magnetic material, it is necessary to carry out the pressing at a higher pressure than when a liquid or pasty composite magnetic material is used, so that the coil conductor 30 is more liable to deform or to be disconnected. To prevent such deformation or disconnection, it is preferable to make the pressure for press-molding the upper magnetic element body 12 lower than that for press-molding the lower magnetic element body 11. In this case, even when the same composite magnetic material is used, the lower magnetic element body 11 becomes higher in density than the upper magnetic element body 12, allowing a boundary therebetween to be visually confirmed.

Figure 9:
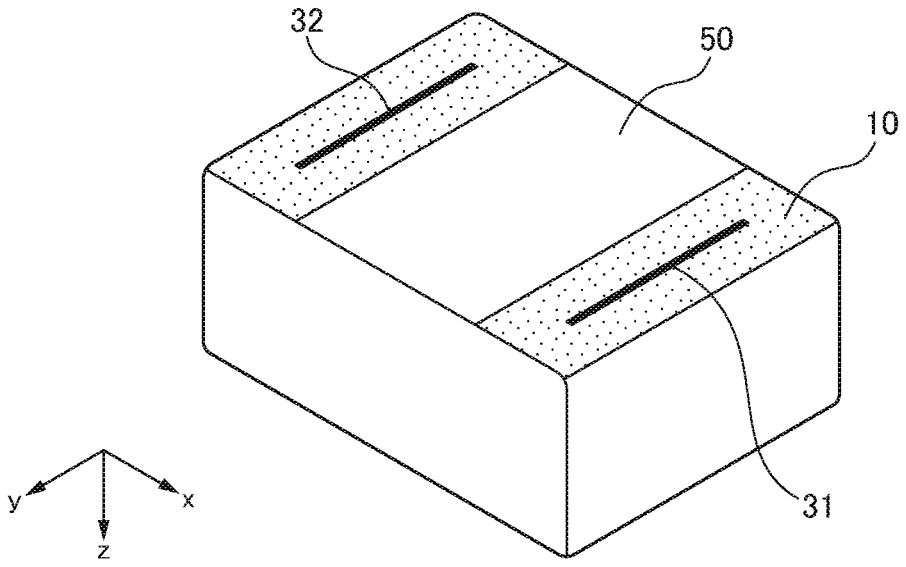
FIG. 9 is a schematic perspective view illustrating a state where the one and the other ends of the coil conductor are exposed by partial peeling of a resin coating.

Then, the resin coating 50 is formed on the entire surface of the magnetic element body 10 (step S4), followed by irradiation of laser beam to peel the resin coating 50 of a portion covering the one and the other end 31 and 32 of the coil conductor 30 (step S5). As a result, as illustrated in FIG. 9, the one and the other ends 31 and 32 of the coil conductor 30 are exposed, and the insulating coating 33 at the exposed portions is removed, whereby the coil conductor 30 has the exposed surface A. At this time, a part of the insulating coating 33 that is embedded in the magnetic element body 10 is preferably removed by adjusting the irradiation time or output of the laser beam to form the inner exposed surface A2. Further, the exposed surface A of the coil conductor 30 is preferably roughened by adjusting the irradiation time or output of the laser beam.

Then, the first conductive resin 41 is formed on the exposed surface of the magnetic element body 10 so as to contact the one and the other ends 31 and 32 of the coil conductor 30 (step S6), and the second conductive resin 42 that covers the first conductive resin 41 and resin coating 50 is formed (step S7). Specifically, the first and second conductive resins 41 and 42 can be formed by application of a pasty conductive resin material, followed by curing thereof. As described above, the specific surface area of the conductive particles contained in the first conductive resin 41 is larger than that of the conductive particles contained in the second conductive resin 42. Thus, the first conductive resin 41 directly contacting the one and the other ends 31 and 32 of the coil conductor 30 can be improved in terms of connection reliability with respect to the one and the other ends 31 and 32. On the other hand, the second conductive resin 42 does not directly contact the one and the other ends 31 and 32 of the coil conductor 30, allowing conductive particles with a small specific surface area and a large particle volume to be used therefor.

The first and second conductive resins 41 and 42 each preferably contain sintered metal. The sintered metal may be nanosized silver (Ag). Using the first and second conductive resins 41 and 42 containing the sintered metal, the conductive particles not only contact with each other but also are bonded together through the sintered metal during sintering, thereby allowing resistance values of the first and second conductive resins 41 and 42 to be reduced. Particularly, when the sintered metal is added to the first conductive resin 41, an alloy layer is formed on the surface of the coil conductor 30, allowing connection reliability between the coil conductor 30 and the first conductive resin 41 to be further improved. For example, when a core material of the coil conductor 30 is made of copper (Cu), and the sintered metal is nanosized silver (Ag), an alloy layer of copper (Cu) and silver (Ag) is formed on the surfaces of the one and the other ends 31 and 32 of the coil conductor 30.

Then, the metal film 43 is formed by electrolytic plating on the surfaces of the first and second conductive resins 41 and 42, whereby the coil component 1 according to the present embodiment is completed. When the metal film 43 is formed by electrolytic plating, the conductive particles contained in the first and second conductive resins 41 and 42 and the metal film 43 are metal-bonded. Thus, conductive particles with a higher particle volume can provide a higher bonding strength. Since most of the metal film 43 contacts the second conductive resin 42 in the present embodiment, the bonding strength of the metal film 43 can be enhanced. When a conductive magnetic material is exposed to the surface of the magnetic element body 10, the metal film 43 may be unintentionally formed also on the surface of the magnetic element body 10 in the stage of formation of the metal film 43 by electrolytic plating. However, by covering the surface of the magnetic element body 10 with the resin coating 50 in advance, it is possible to prevent the metal film 43 from being formed on an unintended portion.

It is apparent that the present invention is not limited to the above embodiments, but may be modified and changed without departing from the scope and spirit of the invention.

What is claimed is:

1. A coil component comprising:

a magnetic element body;

a coil conductor embedded in the magnetic element body and having an end portion exposed from the magnetic element body, wherein the coil conductor includes a wire-shaped metal core coated with an insulating coating; and a terminal electrode connected to the metal core at the end portion of the coil conductor, wherein the terminal electrode includes a conductive resin contacting the metal core at the end portion of the coil conductor and containing conductive particles and a resin material, and a metal film covering the conductive resin, wherein the metal core at the end portion of the coil conductor has first, second, and third surfaces, wherein the first surface is exposed from the magnetic element body and contacts the conductive resin, wherein a part of the conductive resin is located between the second surface and the magnetic element body, wherein the insulating coating is located between the third surface and the magnetic element body, and wherein the first surface is larger in surface roughness than the third surface.

2. The coil component as claimed in claim 1, wherein a surface of the magnetic element body is covered with a resin coating, and wherein a part of the conductive resin is formed on the resin coating.

3. The coil component as claimed in claim 1, wherein the conductive particles contained in the conductive resin are bonded together through sintered metal.

4. The coil component as claimed in claim 1, wherein the magnetic element body includes a lower magnetic element body positioned within the inner diameter region of the coil conductor and an upper magnetic element body positioned outside the coil conductor, and wherein a density of the lower magnetic element body is higher than a density of the upper magnetic element body.

5. The coil component as claimed in claim 1, wherein the first surface is larger in surface roughness than the second surface.

6. The coil component as claimed in claim 1, wherein the first surface protrudes from the magnetic element body.

7. The coil component as claimed in claim 1, wherein a thickness of the part of the conductive resin located between the second surface and the magnetic element body is a same as a thickness of the insulating coating.

8. The coil component as claimed in claim 1, wherein a cross section of the coil conductor is a circular shape.

9. The coil component as claimed in claim 1, wherein each of the first, second, and third surfaces is a curved plane.

* * * * *